US008296159B2

(12) United States Patent
Neuendorf et al.

(10) Patent No.: US 8,296,159 B2
(45) Date of Patent: Oct. 23, 2012

(54) APPARATUS AND A METHOD FOR CALCULATING A NUMBER OF SPECTRAL ENVELOPES

(75) Inventors: Max Neuendorf, Nuremberg (DE); Bernhard Grill, Lauf (DE); Ulrich Kraemer, Stuttgart (DE); Markus Multrus, Nuremberg (DE); Harald Popp, Tuchenbach (DE); Nikolaus Rettelbach, Nuremberg (DE); Frederik Nagel, Nuremberg (DE); Markus Lohwasser, Hersbruck (DE); Marc Gayer, Erlangen (DE); Manuel Jander, Erlangen (DE); Virgilio Bacigalupo, Nuremberg (DE)

(73) Assignee: Fraunhofer-Gesellschaft zur Foerderung der Angewandten Forschung E.V., Munich (DE)

( * ) Notice: Subject to any disclaimer, the term of this patent is extended or adjusted under 35 U.S.C. 154(b) by 0 days.

(21) Appl. No.: 13/004,255

(22) Filed: Jan. 11, 2011

(65) Prior Publication Data

US 2011/0202358 A1 Aug. 18, 2011

Related U.S. Application Data

(63) Continuation of application No. PCT/EP2009/004523, filed on Jun. 23, 2009.

(60) Provisional application No. 61/079,841, filed on Jul. 11, 2008.

(51) Int. Cl.
*G10L 19/00* (2006.01)

(52) U.S. Cl. ..... 704/500; 704/200; 704/200.1; 704/216; 704/217; 704/218; 704/501

(58) Field of Classification Search ..... 704/200–201, 704/216–218, 500–501
See application file for complete search history.

(56) References Cited

U.S. PATENT DOCUMENTS

| | | | | |
|---|---|---|---|---|
| 6,134,518 | A | 10/2000 | Cohen et al. | |
| 7,050,972 | B2 | 5/2006 | Henn et al. | |
| 7,991,621 | B2 * | 8/2011 | Oh et al. | 704/500 |
| 8,036,394 | B1 | 10/2011 | Yonemoto et al. | |
| 2003/0004711 | A1 | 1/2003 | Koishida et al. | |

(Continued)

FOREIGN PATENT DOCUMENTS

EP 1672618 A1 6/2006

(Continued)

OTHER PUBLICATIONS

International Search Report, mailed Jan. 11, 2010, in related PCT application PCT/EP2009/004523, 7 pages.

(Continued)

*Primary Examiner* — Douglas Godbold
(74) *Attorney, Agent, or Firm* — Michael A. Glenn; Glenn Patent Group

(57) ABSTRACT

An apparatus calculates a number of spectral envelopes to be derived by a spectral band replication (SBR) encoder, wherein the SBR encoder is adapted to encode an audio signal using a plurality of sample values within a predetermined number of subsequent time portions in an SBR frame extending from an initial time to a final time, the predetermined number of subsequent time portions being arranged in a time sequence given by the audio signal. The apparatus has a decision value calculator for determining a decision value, the decision value measuring a deviation in spectral energy distributions of a pair of neighboring time portions. The apparatus further has a detector for detecting a violation of a threshold by the decision value and a processor for determining a first envelope border between the pair of neighboring time portions when the violation of the threshold is detected.

18 Claims, 7 Drawing Sheets

U.S. PATENT DOCUMENTS

| | | | | |
|---|---|---|---|---|
| 2005/0096917 | A1 | 5/2005 | Kjorling et al. | |
| 2006/0106619 | A1 | 5/2006 | Iser et al. | |
| 2006/0136211 | A1 | 6/2006 | Jiang et al. | |
| 2006/0256971 | A1 | 11/2006 | Chong et al. | |
| 2007/0016411 | A1 | 1/2007 | Kim et al. | |
| 2007/0106502 | A1 | 5/2007 | Kim et al. | |
| 2007/0150269 | A1 | 6/2007 | Nongpiur et al. | |
| 2007/0225971 | A1 | 9/2007 | Bessette | |
| 2007/0282603 | A1 | 12/2007 | Bessette | |
| 2008/0027715 | A1 | 1/2008 | Rajendran et al. | |
| 2008/0120116 | A1 * | 5/2008 | Schnell et al. | 704/500 |
| 2009/0076829 | A1 | 3/2009 | Ragot et al. | |
| 2009/0110208 | A1 | 4/2009 | Choo et al. | |
| 2009/0132261 | A1 | 5/2009 | Kjorling et al. | |
| 2009/0157413 | A1 | 6/2009 | Oshikiri | |
| 2009/0319259 | A1 | 12/2009 | Liljeryd et al. | |
| 2010/0121646 | A1 | 5/2010 | Ragot et al. | |
| 2010/0211399 | A1 | 8/2010 | Liljeryd et al. | |
| 2010/0286990 | A1 | 11/2010 | Biswas et al. | |
| 2010/0286991 | A1 | 11/2010 | Hedelin et al. | |
| 2011/0173004 | A1 | 7/2011 | Bessette et al. | |
| 2011/0200198 | A1 | 8/2011 | Grill et al. | |

FOREIGN PATENT DOCUMENTS

| | | | |
|---|---|---|---|
| EP | 2056294 | | 5/2009 |
| EP | 2077551 | A | 3/2011 |
| WO | WO00/45379 | | 8/2000 |
| WO | WO-0045379 | | 8/2000 |
| WO | WO00/63887 | A1 | 10/2000 |
| WO | WO01/26095 | A1 | 4/2001 |
| WO | WO 01/26095 | A1 | 4/2001 |
| WO | WO02/41302 | | 5/2002 |
| WO | WO03/046891 | | 6/2003 |
| WO | WO2004/114133 | | 12/2004 |
| WO | WO2006/000110 | | 1/2006 |
| WO | WO2008/031458 | | 3/2008 |
| WO | WO-2008060068 | | 5/2008 |
| WO | WO2009/081315 | | 7/2009 |

OTHER PUBLICATIONS

Int'l Preliminary Report on Patentability, mailed Jan. 11, 2011, in related PCT application PCT/EP2009/004523, 9 pages.

* cited by examiner

APPARATUS AND A METHOD FOR CALCULATING A NUMBER OF SPECTRAL ENVELOPES

CROSS-REFERENCE TO RELATED APPLICATIONS

This application is a continuation of copending International Application No. PCT/EP2009/004523, filed Jun. 23, 2009, which is incorporated herein by reference in its entirety, and additionally claims priority from U.S. Provisional Application No. 61/079,841, filed Jul. 11, 2008, which is also incorporated herein by reference in its entirety.

BACKGROUND OF THE INVENTION

The present invention relates to an apparatus and a method for calculating a number of spectral envelopes, an audio encoder and a method for encoding audio signals.

Natural audio coding and speech coding are two major tasks of codecs for audio signals. Natural audio coding is commonly used for music or arbitrary signals at medium bit rates and generally offers wide audio bandwidths. On the other hand, speech coders are basically limited to speech reproduction, but can also be used at a very low bit rate.

Wide band speech offers a major subjective quality improvement over narrow band speech. Increasing the bandwidth not only improves the intelligibility and naturalness of speech, but also the speaker's recognition. Wide band speech coding is, thus, an important issue in the next generation of telephone systems. Further, due to the tremendous growth of the multimedia field, transmission of music and other non-speech signals at high quality over telephone systems is a desirable feature.

To drastically reduce the bit rate, source coding can be performed using split-band perceptional audio codecs. These natural audio codecs exploit perceptional irrelevancy and statistical redundancy in the signal. Moreover, it is common to reduce the sample rate and, thus, the audio bandwidth. It is also common to decrease the number of composition levels, occasionally allowing audible quantization distortion and to employ degradation of the stereo field through intensity coding. Excessive use of such methods results in annoying perceptional degradation. In order to improve the coding performance, spectral band replication is used as an efficient method to generate high frequency signals in a high frequency reconstruction (HFR) based codec.

Spectral band replication (SBR) comprises a technique that gained popularity as an add-on to popular perceptual audio coders such as MP3 and the advanced audio coding (AAC). SBR comprises a method of bandwidth extension in which the low band (base band or core band) of the spectrum is encoded using an state of the art codec, whereas the upper band (or high band) is coarsely parameterized using few parameters. SBR makes use of a correlation between the low band and the high band by predicting the wider band signal from the lower band using the extracted high band features. This is often sufficient, since the human ear is less sensitive to distortions in the higher band compared to the lower band. New audio coders, therefore, encode the lower spectrum using, for example, MP3 or AAC, whereas the higher band is encoded using SBR. The key to the SBR algorithm is the information used to describe the higher frequency portion of the signal. The primary design goal of this algorithm is to reconstruct the higher band spectrum without introducing any artifacts and to provide good spectral and temporal resolution. For example, a 64-band complex-valued polyphase filterbank is used at the analysis portion and at the encoder; the filterbank is used to obtain, e.g., energy samples of the original input signal's high band. These energy samples may then be used as reference values for an envelope adjustment scheme used at the decoder.

Spectral envelopes refer to a coarse spectral distribution of the signal in a general sense and comprise for example, filter coefficients in a linear predictive-based coder or a set of time-frequency averages of sub-band samples in a sub-band coder. Envelope data refers, in turn, to the quantized and coded spectral envelope. Especially if the lower frequency band is coded with a low bit rate, the envelope data constitutes a larger part of the bitstream. Hence, it is important to represent the spectral envelope compactly when using especially lower bit rates.

The spectral band replication makes use of tools, which are based on a replication of, e.g., sequences of harmonics, truncated during encoding. Moreover, it adjusts the spectral envelope of the generated high-band and applies inverse filtering and adds noise and harmonic components in order to recreate the spectral characteristics of the original signal. Therefore, the input of the SBR tool comprises, for example the quantized envelope data, miscellaneous control data, a time domain signal from the core coder (e.g. AAC or MP3). The output of the SBR tool is either a time domain signal or a QMF-domain (QMF=Quadrature Mirror Filter) representation of a signal as, for example, in case the MPEG surround tool is used. The description of the bit stream elements for the SBR payload can be found in the Standard ISO/IEC 14496-3:2005, sub-clause 4.5.2.8 and comprise among other data SBR extension data, an SBR header and indicates the number of SBR envelopes within an SBR frame.

For the implementation of an SBR on the encoder side, an analysis is performed on the input signal. Information obtained from this analysis is used to choose the appropriate time/frequency resolution of the current SBR frame. The algorithm calculates the start and stop time borders of the SBR envelopes in the current SBR frame, the number of SBR envelopes as well as their frequency resolution. The different frequency resolutions are calculated as described, for example, in the ISO/IEC 14496 3 Standard in sub-clause 4.6.18.3. The algorithm also calculates the number of noise floors for the given SBR frame and the start and stop time borders of the same. The start and stop time borders of the noise floors should be a sub-set of the start and stop time borders of the spectral envelopes. The algorithm divides the current SBR frame into four classes:

FIXFIX—Both the leading and the trailing time border equal nominal SBR-frame boundaries. All SBR envelope time borders in the frame are uniformly distributed in time. The number of envelopes is an integer power of two (1, 2, 4, 8, . . . ).

FIXVAR—The leading time border equals the leading nominal frame boundary. The trailing time border is variable and can be defined by bit stream elements. All SBR envelope time borders between the leading and the trailing time border can be specified as the relative distance in time slots to the previous border, starting from the trailing time border.

VARFIX—The leading time border is variable and be defined by bit stream elements. The trailing time border equals the trailing nominal frame boundary. All SBR envelope time borders between the leading and trailing time borders are specified in the bit stream as the relative distance in time slots to the previous border, starting from the leading time border.

VARVAR—Both, the leading and trailing time borders are variable and can be defined in the bit stream. All SBR envelope time borders between the leading and trailing time borders are also specified. The relative time borders starting from the leading time border are specified as the relative distance to the previous time border. The relative time borders starting from the trailing time border are specified as the relative distance to the previous time border.

There are no restrictions on SBR frame class transitions, i.e. any sequence of classes is allowed in the Standard. However, in accordance with this Standard, the maximal number of SBR envelopes per the SBR frame is restricted to 4 for class FIXFIX and 5 for class VARVAR. Classes FIXVAR and VARFIX are syntactically limited to four SBR envelopes. The spectral envelopes of the SBR frame are estimated over the time segment and with the frequency resolution given by the time/frequency grid. The SBR envelope is estimated by averaging the squared complex sub-band samples over the given time/frequency regions.

Transients receive in SBR, in general, a specific treatment by employing specific envelopes of variable lengths. Transients can be defined by portions within conventional signals, wherein a strong increase in energy appears within a short period of time, which may or may not be constrained on a specific frequency region. Examples for transients are hits of castanets and of percussion instruments, but also certain sounds of the human voice as, for example, the letters: P, T, K, . . . . The detection of this kind of transient is implemented so far always in the same way or by the same algorithm (using a transient threshold), which is independent of the signal, whether it is classified as speech or classified as music. In addition, a possible distinction between voiced and unvoiced speech does not influence the conventional or classical transient detection mechanism.

Hence, in case a transient is detected, the SBR-data should be adjusted in order that a decoder can replicate the detected transient appropriately. In WO 01/26095, an apparatus and a method is disclosed for spectral envelope coding, which takes into account a detected transient in the audio signal. In this conventional method, a non-uniform time and frequency sampling of the spectral envelope is achieved by an adaptively grouping sub-band samples from a fixed-size filterbank into frequency bands and time segments, each of which generates one envelope sample. The corresponding system defaults to long-time segments and high-frequency resolution, but in the vicinity of a transient, shorter time segments are used, whereby larger frequency steps can be used in order to keep the data size within limits. In case a transient is detected, the system switches from a FIXFIX-frame to a FIXVAR frame followed by a VARFIX-frame such that an envelope border is fixed right before the detected transient. This procedure repeats whenever a transient is detected.

In case the energy fluctuation changes only slowly, the transient detector will not detect the change. These changes may, however, be strong enough to generate perceivable artifacts if not treated appropriately. A simple solution would be to lower the threshold in the transient detector. This would, however, result in a frequent switch between different frames (FIXFIX to FIXVAR+VARFIX). As consequence, a significant amount of additional data has to be transmitted implying a poor coding effieciency—especially if the slow increase last over longer time (e.g. over multiple frames). This is not acceptable, since the signal does not comprise the complexity, which would justify a higher data rate and hence this is not an option to solve the problem.

SUMMARY

According to an embodiment, an apparatus for calculating a number of spectral envelopes to be derived by a spectral band replication (SBR) encoder, wherein the SBR encoder is adapted to encode an audio signal using a plurality of sample values within a predetermined number of subsequent time portions in an SBR frame extending from an initial time to a final time, the predetermined number of subsequent time portions being arranged in a time sequence given by the audio signal, may have: a decision value calculator for determining a decision value, the decision value measuring a deviation in spectral energy distributions of a pair of neighboring time portions; a detector for detecting a violation of a threshold by the decision value; a processor for determining a first envelope border between the pair of neighboring time portions when the violation of the threshold is detected; a processor for determining a second envelope border between a different pair of neighboring time portions or at the initial time or at the final time for an envelope having the first envelope border based on the violation of the threshold for the other pair or based on a temporal position of the pair or the different pair in the SBR frame; and a number processor for establishing the number of spectral envelopes having the first envelope border and the second envelope border.

According to another embodiment, an encoder for encoding an audio signal may have: a core coder for encoding the audio signal within a core frequency band; an apparatus for calculating a number of spectral envelopes as mentioned above; and an envelope data calculator for calculating envelope data based on the audio signal and the number.

According to another embodiment, a method for calculating a number of spectral envelopes to be derived by a spectral band replication (SBR) encoder, wherein the SBR encoder is adapted to encode an audio signal using a plurality of sample values within a predetermined number of subsequent time portions in an SBR frame extending from an initial time to a final time, the predetermined number of subsequent time portions being arranged in a time sequence given by the audio signal, may have the steps of: determining a decision value, the decision value measuring a deviation in spectral energy distributions of a pair of neighboring time portions; detecting a violation of a threshold by the decision value; determining a first envelope border between the pair of neighboring time portions when the violation of the threshold is detected; determining a second envelope border between a different pair of neighboring time portions or at the initial time or at the final time for an envelope having the first envelope border based on the violation of the threshold for the other pair or based on a temporal position of the pair or the different pair in the SBR frame; and establishing the number of spectral envelopes having the first envelope border and the second envelope border.

Another embodiment may have a computer program for performing, when running on a processor, a method for calculating a number of spectral envelopes as mentioned above.

The present invention is based on the finding that the perceptual quality of a transmitted audio signal can be increased by adjusting in a flexible way the numbers of spectral envelopes within an SBR frame in accordance to a given signal. This is achieved by comparing the audio signal of neighboring time portions within the SBR frame. The comparison is performed by determining energy distributions for the audio signal within the time portions, and a decision value measures a deviation of the energy distributions of two neighboring time portions. Depending on whether the decision value violates a threshold, an envelope border is located between the neighboring time portions. The other border of the envelope can either be at the beginning or at the end of the SBR frame or, alternatively, also between two further neighboring time portions within the SBR frame.

As result, the SBR frame is not adapted or changed as, for example, in a conventional apparatus where a change from a FIXFIX-frame to a FIXVAR-frame or to a VARFIX frame is performed in order to treat transients. Instead, embodiments use a varying number of envelopes, for example within FIXFIX-frames, in order to take into account varying fluctuations of the audio signal so that even slowly-varying signals can result in a changing number of envelopes and, therewith, allow a better audio quality to be produced by the SBR tool in a decoder. The determined envelopes may, for example, cover portions of equal time length within the SBR frame. For example, the SBR frame can be divided into a predetermined number of time portions (which may, for example, comprise 4, 8 or other integer powers of 2).

The spectral energy distribution of each time portion may cover only the upper frequency band, which is replicated by SBR. On the other hand, the spectral energy distribution may also be related to the whole frequency band (upper and lower), wherein the upper frequency band may or may not be weighted more than the lower frequency band. By this procedure, already one violation of the threshold value may be sufficient to increase the number of envelopes or to use maximal number of envelops within the SBR frame.

Further embodiments may also comprise a signal classifier tool, which analyses the original input signal and generates control information therefrom, which triggers the selection of different coding modes. The different coding modes may, for example, comprise a speech coder and a general audio coder. The analysis of the input signal is implementation-dependent with the aim to choose the optimal core coding mode for a given input signal frame. The optimum relates to a balancing of a perceptual high quality while using only low bit rate for encoding. The input to the signal classifier tool may be the original unmodified input signal and/or additional implementation-dependent parameters. The output of the signal classifier tool may, for example, be a control signal to control the selection of the core codec.

If, for example, the signal is identified or classified as speech, the time-like resolution of the bandwidth extension (BWE) may be increased (e.g. by more envelopes) so that a time-like energy fluctuation (slowly- or strongly-fluctuating) may better be taken into account.

This approach takes into account that different signals with different time/frequency characteristics have different demands on characteristic on the bandwidth extension. For example, transient signals (appearing, for example, in speech signals) need a fine temporal resolution of the BWE, the crossover frequency (that means the upper frequency border of the core coder) should be as high as possible. Especially in voiced speech, a distorted temporal structure can decrease perceived quality. On the other hand, tonal signals often need a stable reproduction of spectral components and a matching harmonic pattern of the reproduced high frequency portions. The stable reproduction of tonal parts limits the core coder bandwidth—it does not need a BWE with fine temporal, but instead a finer spectral resolution. In a switched speech/audio core coder design, it is moreover possible to use the core coder decision to adapt both, the temporal and spectral characteristics of the BWE as well as to adapt the core coder bandwidth to the signal characteristics.

If all envelopes comprise the same length in time, depending on the detected violation (at which time), the number of envelopes may differ from frame to frame. Embodiments determine the number of envelopes for an SBR frame, for example, in the following way. It is possible to start with a partition of a maximum possible number of envelopes (for example, 8) and to reduce the number of envelopes step-by-step so that depending on the input signal, no more envelopes are used than needed to enable a reproduction of the signal in a perceptually high quality.

For example, a violation detected already at the first border of time portions within the frame may result in a maximal number of envelops, whereas a violation only detected at the second border may result in half the maximal number of envelopes. In order to reduce the data to be transmitted, in further embodiments the threshold value may depend on the time instant (i.e. depending on which border is currently analysed). For example, between the first and second time portions (first border) and between the third and fourth time portions (third border) the threshold may in both cases be higher than between the second and third time portions (second border). Thus, statistically there will be more violations at the second border than at the first or third border and hence fewer envelopes are more likely, which would be of advantage (for more details see below).

In further embodiments the length in time of a time portion of the predetermined number of subsequent time portions is equal to a minimal length in time, for which a single envelope is determined, and in which the decision value calculator is adapted to calculate a decision value for two neighboring time portions having the minimal length in time.

Yet further embodiments comprise an information processor for providing additional side information, the additional side information comprises the first envelope border and the second envelope border within the time sequence of the audio signal. In further embodiments the detector is adapted to investigate in a temporal order each of the borders between neighboring time portions.

Embodiments also use the apparatus for calculating the number of envelopes within an encoder. The encoder comprises the apparatus to calculate the number of the spectral envelope and an envelope calculator uses this number to calculate the spectral envelope data for an SBR frame. Embodiments also comprise a method for calculating the number of envelops and a method for encoding an audio signal.

Therefore, the use of envelopes within FIXFIX frames aim for a better modeling of energy fluctuation, which are not covered by said transient treatments, since they are too slow in order to be detected as transients or to be classified as transients. On the other hand, they are fast enough to cause artifacts if they are not treated appropriately, due to insufficient time-like resolution. Therefore, the envelope treatment according to the present invention will take into account slowly varying energy fluctuations and not only the strong or rapid energy fluctuations, which are characteristic for transients. Hence, embodiments of the present invention allow a more efficient coding in a better quality, especially for signals with a slowly-varying energy, whose fluctuation intensity is too low to be detected by the conventional transient detectors.

BRIEF DESCRIPTION OF THE DRAWINGS

The present invention will now be described by illustrated examples. Features of the invention will be more readily appreciated and better understood by reference to the following detailed description, which should be considered with reference to the accompanying drawings, in which.

DETAILED DESCRIPTION OF THE INVENTION

The embodiments described below are merely illustrative for the principle of the present invention for improving the spectral band replication, for example, used within an audio encoder. It is understood that modifications and variations of the arrangements and the details described herein will be apparent to others skilled in the art. It is the intent, therefore, not to be limited by the specific details presented by way of the description and the explanation of the embodiments herein.

Figure 1:
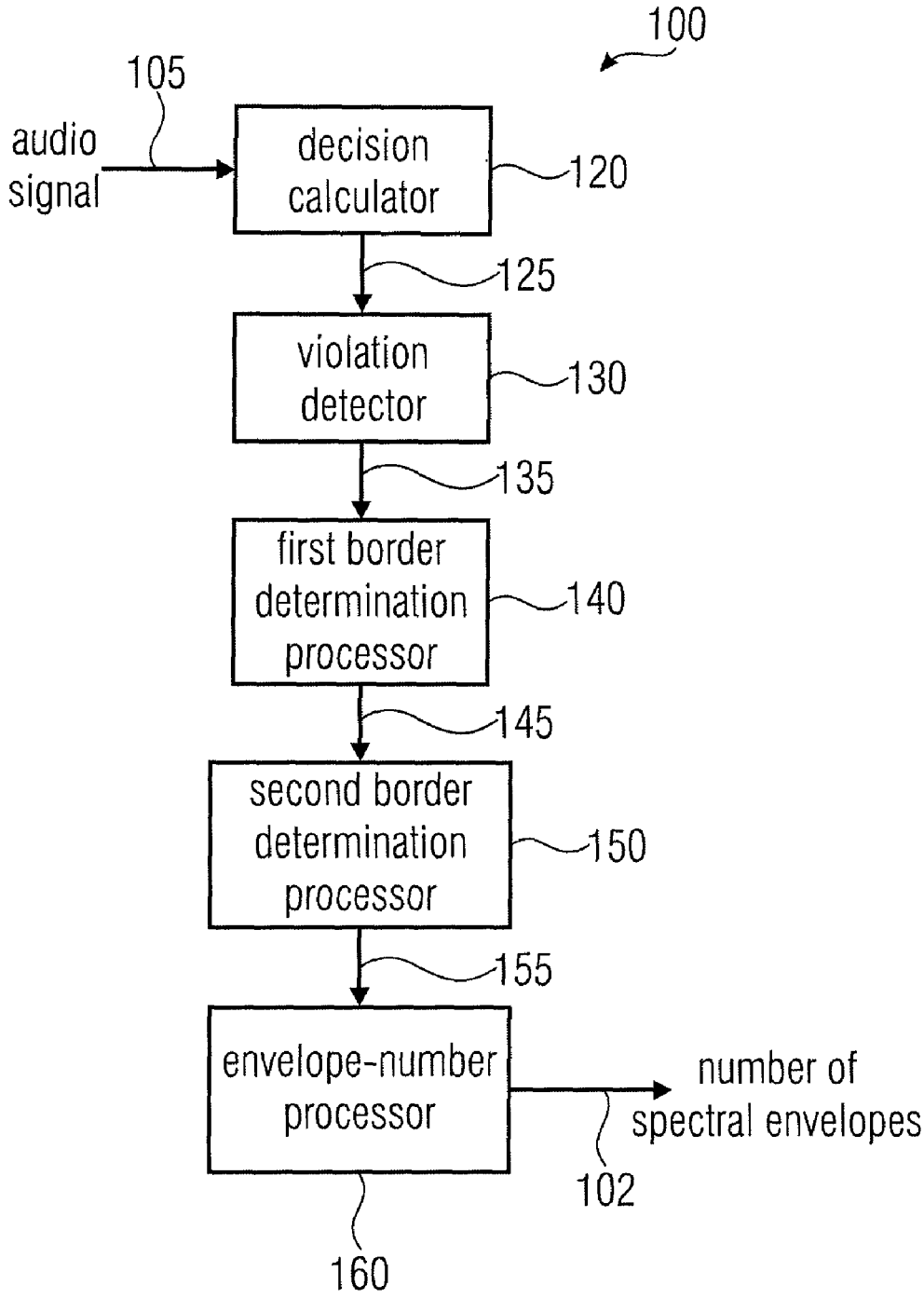
FIG. 1 shows a block diagram of an apparatus for calculating a number of spectral envelopes according to embodiments of the present invention.

FIG. 1 shows an apparatus 100 for calculating a number 102 of spectral envelopes 104. The spectral envelopes 104 are derived by a spectral band replication encoder, wherein the encoder is adapted to encode an audio signal 105 using a plurality of sample values within a predetermined number of subsequent time portions 110 in a spectral band replication frame (SBR frame) extending from an initial time t0 to a final time tn. The predetermined number of subsequent time portions 110 is arranged in a time sequence given by the audio signal 105.

The apparatus 100 comprises a decision value calculator 120 for determining a decision value 125, wherein the decision value 125 measures a deviation in spectral energy distributions of a pair of neighboring time portions. The apparatus 100 further comprises a violation detector 130 for detecting a violation 135 of a threshold by the decision value 125. Moreover, the apparatus 100 comprises a processor 140 (first border determination processor) for determining a first envelope border 145 between the pair of neighboring time portions when a violation 135 of the threshold is detected. The apparatus 100 also comprises a processor 150 (second border determination processor) for determining a second envelope border 155 between a different pair of neighboring time portions or at the initial time t0 or of the final time tn for an envelope 104 having the first envelope border 145 based on a violation 135 of the threshold for the other pair or based on a temporal position of the pair or the other pair in the SBR frame. Finally, the apparatus 100 comprises a processor 160 (envelope number processor) for establishing the number 102 of spectral envelopes 104 having the first envelope border 145 and the second envelope border 155.

Further embodiments comprise an apparatus 100, in which a length of time of a time portion of the predetermined number of the subsequent time portion 110 is equal to a minimal length in time for which a single envelope 104 is determined. Moreover, the decision value calculator 120 is adapted to calculate a decision value 125 for two neighboring time portions having the minimal length in time.

Figure 2:
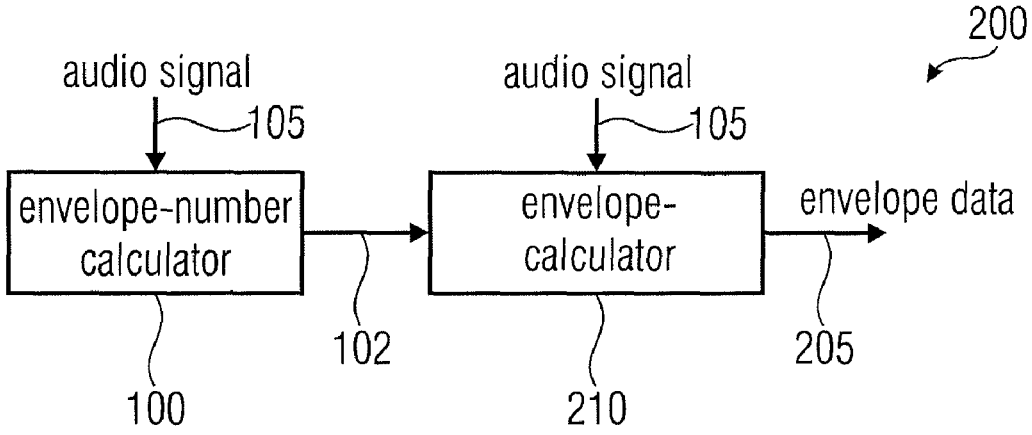
FIG. 2 shows a block diagram of an SBR module comprising an envelope number calculator.

FIG. 2 shows an embodiment for an SBR tool comprising the envelope number calculator 100 (shown in FIG. 1), which determines the number 102 of spectral envelopes 104 by processing the audio signal 105. The number 102 is input into an envelope calculator 210, which calculates the envelope data 205 from the audio signal 105. Using the number 102, the envelope calculator 210 will divide the SBR frame into portions covered by a spectral envelope 104 and for each spectral envelope 104 the envelope calculator 210 calculates the envelope data 205. The envelope data comprises, for example, the quantized and coded spectral envelope, and this data is needed on the decoder side for generating the high-band signal and applying inverse filtering, adding noise and harmonic components in order to replicate the spectral characteristics of the original signal.

Figure 3A:
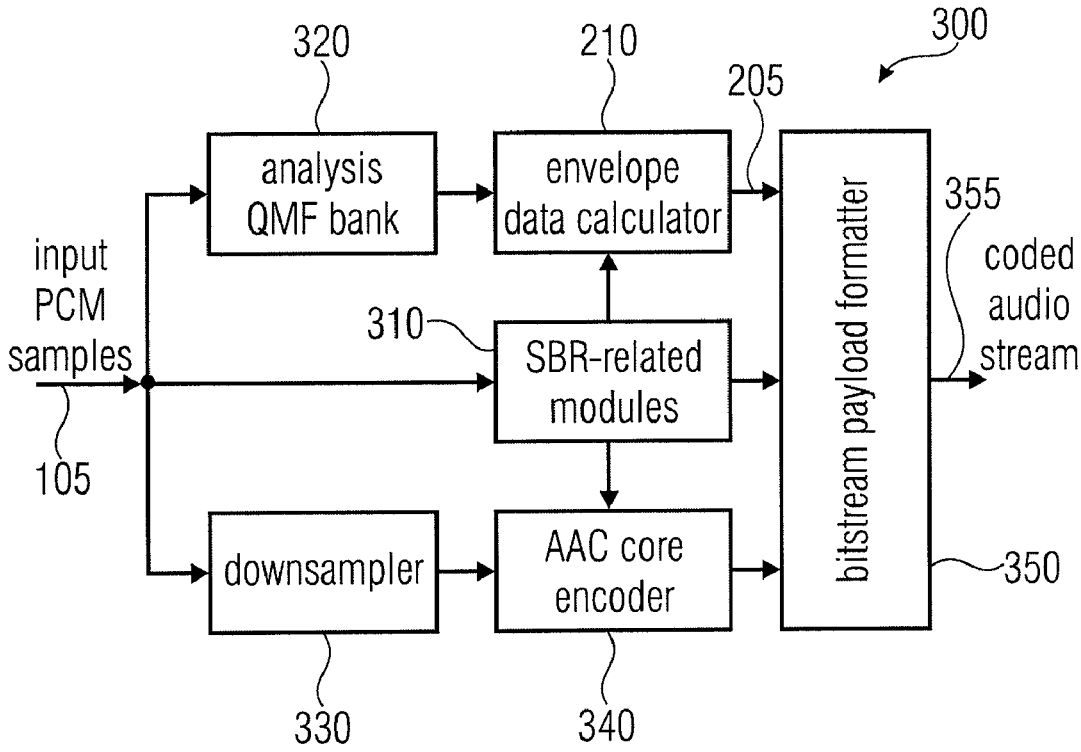
FIGS. 3*a* and 3*b* show block diagrams of an encoder comprising an envelope number calculator.

FIG. 3*a* shows an embodiment for an encoder 300, the encoder 300 comprises SBR related modules 310, an analysis QMF bank 320, a down-sampler 330, an AAC core encoder 340 and a bit stream payload formatter 350. In addition, the encoder 300 comprises the envelope data calculator 210. The encoder 300 comprises an input for PCM samples (audio signal 105; PCM=pulse code modulation), which is connected to the analysis QMF bank 320, and to the SBR-related modules 310 and to the down-sampler 330. The analysis QMF bank 320, in turn, is connected to the envelope data calculator 210, which, in turn, is connected to the bit stream payload formatter 350. The down-sampler 330 is connected to the AAC core encoder 340, which, in turn, is connected to the bit stream payload formatter 350. Finally, the SBR-related module 310 is connected to the envelope data calculator 210 and to the AAC core encoder 340.

Therefore, the encoder 300 down-samples the audio signal 105 to generate components in the core frequency band (in the down-sampler sampler 330), which are input into the AAC core encoder 340, which encodes the audio signal in the core frequency band and forwards the encoded signal to the bit stream payload formatter 350 in which the encoded audio signal of the core frequency band is added to the coded audio stream 355. On the other hand, the audio signal 105 is analyzed by the analysis QMF bank 320, which extracts frequency components of the high frequency band and inputs these signals into the envelope data calculator 210. For example, a 64 sub-band QMF bank 320 performs the sub-band filtering of the input signal. The output from the filterbank (i.e. the sub-band samples) are complex-valued and, thus, over-sampled by a factor of two compared to a regular QMF bank.

The SBR-related modules 310 controls the envelope data calculator 210 by providing, e.g., the number 102 of envelopes 104 to the envelope data calculator 210. Using the number 102 and the audio components generated by the Analysis QMF bank 320, the envelope data calculator 210 calculates the envelope data 205 and forwards the envelope data 205 to the bit stream payload formatter 350, which combines the envelope data 205 with the components encoded by the core encoder 340 in the coded audio stream 355.

FIG. 3*a* shows therefore the encoder part of the SBR tool estimating several parameters used by the high frequency reconstruction method on the decoder.

Figure 3B:
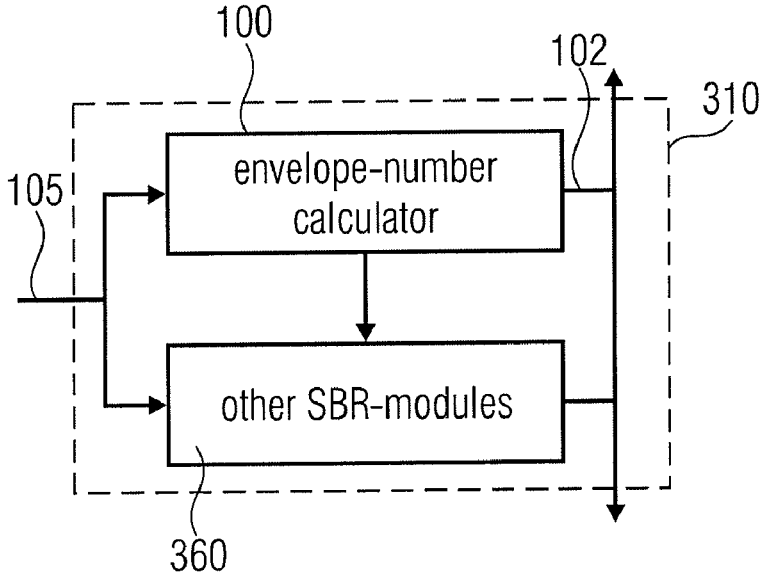

FIG. 3*b* shows an example for the SBR-related module 310, which comprises the envelope number calculator 100 (shown in FIG. 1) and optionally other SBR modules 360. The SBR-related modules 310 receive the audio signal 105 and output the number 102 of envelopes 104, but also other data generated by the other SBR modules 360.

The other SBR modules 360 may, for example, comprise a conventional transient detector adapted to detect transients in the audio signal 105 and may also obtain the number and/or positions of the envelops so that the SBR modules may or may not calculate part of the parameters used by the high frequency reconstruction method on the decoder (SBR parameter).

As said before within SBR an SBR time unit (an SBR frame) can be divided into various data blocks, so-called envelopes. If this division or partition is uniform, i.e. that all envelopes 104 have the same size and the first envelope begins and the last envelope ends with a frame boundary, the SBR frame is defined as the FIXFIX frame.

Figure 4:
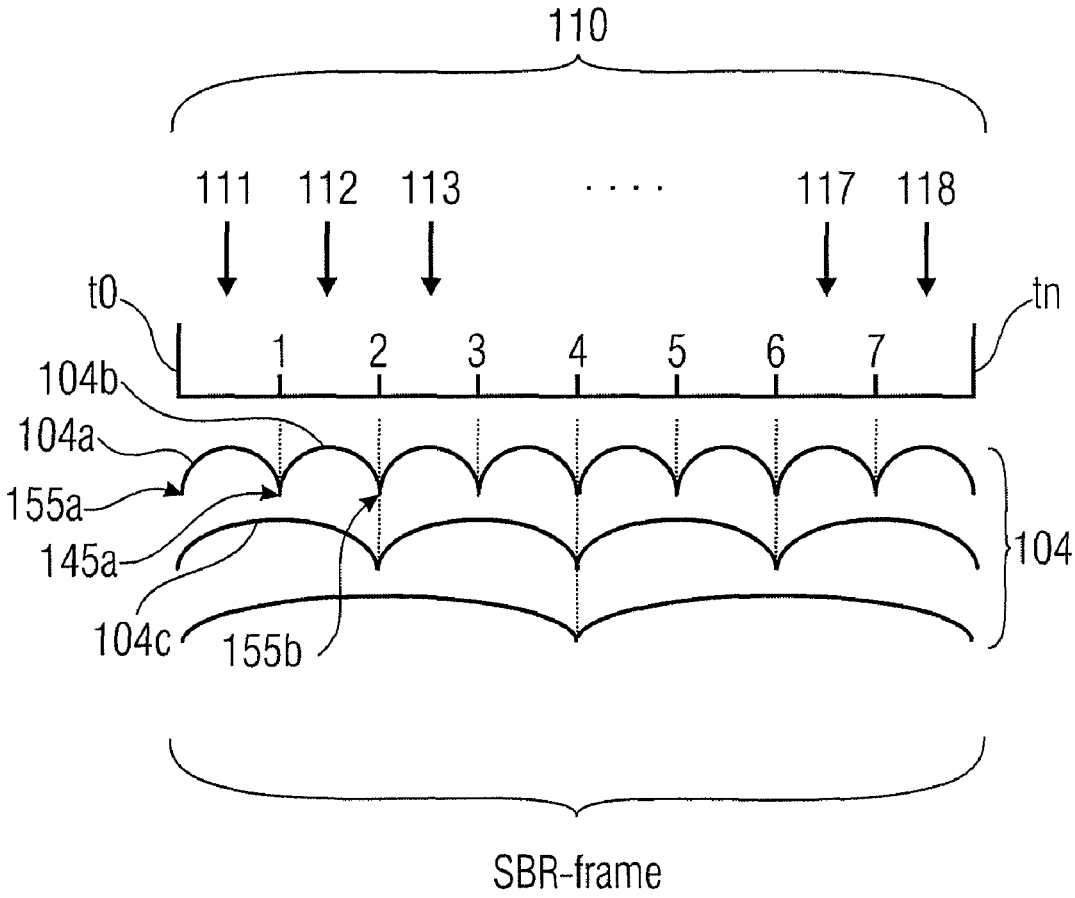
FIG. 4 illustrates the partition of an SBR frame in a predetermined number of time portions.

FIG. 4 illustrates such a partition for an SBR frame in a number 102 of spectral envelopes 104. The SBR frame covers a time period between the initial time t0 and a final time tn and is, in the embodiment shown in FIG. 4, divided into 8 time portions, a first time portion 111, a second time portion 112, . . . , a seventh time portion 117 and an eighth time portion 118. The 8 time portions 110 are separated by 7 borders, that means a border 1 is in-between the first and second time portion 111, 112, a border 2 is located between the second portion 112 and a third portion 113, and so on until a border 7 is in-between the seventh portion 117 and the eighth portion 118.

In the Standard ISO/IEC 14496-3, the maximal number of envelopes 104 in a FIXFIX frame is restricted to four (see sub-part 4, paragraph 4.6.18.3.6). In general, the number of envelopes 104 in the FIXFIX frame could be a power of two (for example, 1, 2, 4), wherein FIXFIX frames are only used if, in the same frame, no transient has been detected. In conventional high-efficiency AAC encoder implementations, on the other hand, the maximal number of envelopes 104 is constrained to two, even if the specification of the standard theoretically allows up to four envelopes. This number of envelopes 104 per frame may be increased, for example, to eight (see FIG. 4), so that a FIXFIX frame may comprise 1, 2, 4 or 8 envelopes (or another power of 2). Of course, any other number 102 of envelopes 104 is also possible so that the maximal number of envelopes 104 (predetermined number) may only be restricted by the time resolution of the QMF filter bank which has 32 QMF time slots per SBR frame.

The number 102 of envelopes 104 may, for example, be calculated as follows. The decision value calculator 120 measures deviations in the spectral energy distributions of pairs of neighboring time portions 110. For example, this means that the decision value calculator 120 calculates a first spectral energy distribution for the first time portion 111, calculates a second spectral energy distribution from the spectral data within the second time portion 112, and so on. Then, the first spectral energy distribution and the second spectral energy distribution are compared and from this comparison the decision value 125 is derived, wherein the decision value 125 relates, in this example, to the border 1 between the first time portion 111 and the second time portion 112. The same procedure may be applied to the second time portion 112 and the third time portion 113 so that for these two neighboring time portions also two spectral energy distributions are derived and these two spectral energy distributions are, in turn, compared by the decision value calculator 120 to derive a further decision value 125.

As next step, the detector 130 will compare the derived decision values 125 with a threshold value and if the threshold value is violated, the detector 130 will detect a violation 135. If the detector 130 detects a violation 135, the processor 140 determines a first envelope border 145. For example, if the detector 130 detects a violation at the border 1 between the first time portion 111 and the second time portion 112, the first envelope border 145*a* is located at the time of the border 1.

In the FIG. 4 embodiment, in which only several possibilities for granules/borders are allowed, this would mean that the whole process is finished, and all borders are set as indicated by the small envelopes indicated at 104*a*, 104*b*. In this case borders would be on all times 0, 1, 2, . . . , n.

When, however, the first border is to be set e.g. on time instant 4, then the search for the second border has to be done. As indicated in FIG. 4, the second border could be at 3, 2, 0. In case of the border being at 3, the whole procedure is finished, since the smallest envelopes 104*a*, 104*b* are set. In case of the border being at 2, the search has to be continued, since it is not yet sure that the medium envelopes (indicated by 145*a*) can be used. Even in case of the border being at 0, it is not yet determined that in the second half, i.e. between 4 and n, there is not a border. If there is not a border in the second half, then the broadest envelopes can be set. If there is a border e.g. at 5, then the smallest envelopes have to be used. If there is a border only at 6, then, the medium envelopes are used.

When, however, a completely flexible or a more flexible pattern for the envelopes is allowed, the procedure continues, when a first border at 1 has been determined. Then, the processor 150 determines a second envelope border 155, which is either between another pair of neighboring time portions or coincides with the initial time t0 or the final time tn. In the embodiments as shown in FIG. 4, the second envelope border 155*a* coincides with the initial time t0 (yielding a first envelope 104*a*) and another second envelope border 155*b* coincides with the border 2 between the second time portion 112 and the third time portion 113 (yielding a second envelope 104*b*). If there is no violation detected at the border 1 between the first time portion 111 and the second time portion 112, the detector 130 will continue to investigate the border 2 between the second time portion 112 and the third time portion 113. If there is a violation, another envelope 104*c* extends from the starting time t0 to the border 2.

According to embodiments of the invention, for a pair of neighboring envelopes, said decision value 125 measures the deviation of the spectral energy distributions, wherein each spectral energy distribution refers to a portion of the audio signal within a time portion. In the example of 8 envelopes, there are a total of 7 measures (=7 borders between neighboring time portions) or, in general, if there are n envelopes, there are n−1 measures (decision values 125). Each of these decision values 125 may then be compared with a threshold and if the decision value 125 (measure) violates the threshold, an envelope border will be located between the two neighboring envelopes. Depending on the definition of the decision value 125 and of the threshold, the violation may either be that a decision value 125 is above or below the threshold. In case the decision value 125 is below the threshold, the spectral distribution may not strongly vary from envelope to envelope. Hence no envelope border may be needed at this position (=moment in time).

In an embodiment, the number 102 of envelopes 104 comprises a power of two and, moreover, each envelope comprise an equal time period. This means that there are four possibilities: A first possibility is that the whole SBR frame is covered by a single envelope (not shown in FIG. 4), the second possibility is that the SBR frame is covered by 2 envelopes, the third possibility is that the SBR frame is covered by 4 envelopes and the last possibility is that the SBR frame is covered by 8 envelopes (shown in FIG. 4 from the bottom to the top).

It may be of advantage to investigate the borders within a specific order, because if there is a violation at an odd border (border 1, border 3, border 5, border 7), the number of envelopes will be eight (under the assumptions of equal sized envelops). On the other hand, if there is a violation at border 2 and border 6, there are four envelopes and, finally, if there is a violation only at border 4, two envelopes will be encoded and if there is no violation at any of the 7 borders, the whole SBR frame is covered by one single envelope. Hence, the apparatus 100 may investigate first the border 1, 3, 5, 7 and if a violation is detected at one of these borders, the apparatus 100 can investigate the next SBR frame, since, in this case the whole SBR frame will be encoded by the maximal number of envelopes. After investigating these odd borders and if no violations are detected at the odd borders, the detector 130 may investigate, as the next step, the border 2 and border 6, so that if a violation is detected at one of these two borders, the number of envelopes will be four and the apparatus 100 can, again, turn to the next SBR frame. As a last step, if there are no violations detected so far as the borders 1, 2, 3, 5, 6, 7, the detector 130 can investigate the border 4 and if a violation is detected at border 4, the number of envelopes are fixed to two.

For the general case (of n time portions, where n is an even number) this procedure may also be re-phrased as follows. If, for example, at the odd borders no violation is detected and therefore the decision value 125 may be below the threshold meaning that the neighboring envelopes (which are separated by those borders) comprise no strong differences with respect to the spectral energy distribution, there is no need to divide the SBR frame into n envelopes and, instead, n/2 envelopes may be sufficient. If furthermore, the detector 130 detects no violations at borders, which are twice an odd number (e.g. at borders 2, 6, 10, . . . ), there is also no need to put an envelope border at these positions and, hence, the number of envelopes can further be reduced by a factor of 2, i.e. to n/4. This procedure is continued step by step (the next step would be the border, which is 4 times an odd number, i.e. 4, 12, . . . ). If at all of these borders no violation is detected, a single envelope for the whole SBR frame is sufficient.

If, however, one of the decision values 125 at the odd borders is above the threshold, n envelopes should be considered, since only then an envelope border will be positioned at the corresponding position (since all envelopes are assumed to have the same length). In this case, n envelopes will be calculated even then if all other decision values 125 are below the threshold.

The detector 130 may, however, also consider all borders and consider all decision values 125 for all time portions 110 in order to calculate the number of envelopes 104.

Since an increase in the number of envelopes 102 also implies an increased amount of data to be transmitted, the decision threshold for the corresponding envelope border, which entails a high number of envelopes 104 may be increased. This means that the threshold value at border 1, 3, 5 and 7 may optionally be higher than the threshold at the borders 2 and 6, which, in turn, may be higher than the threshold at the border 4. Lower or higher thresholds refer here to the case that a violation of the threshold is more or less likely. For example a higher threshold implies that the deviation in the spectral energy distribution between two neighboring time portions may be more tolerable than with a lower threshold and hence for a high threshold more severe deviations in the spectral energy distribution are needed to demand further envelopes.

The chosen threshold may also depend on the signal as to whether the signal is classified as a speech signal or a general audio signal. It is, however, not the case that the decision threshold will be reduced (or increased) if the signal is classified as speech. Depending on the application, it may, however, be of advantage if, for a general audio signal, the threshold is high so that in this case, the number of envelopes is generically smaller than for a speech signal.

Figure 5:
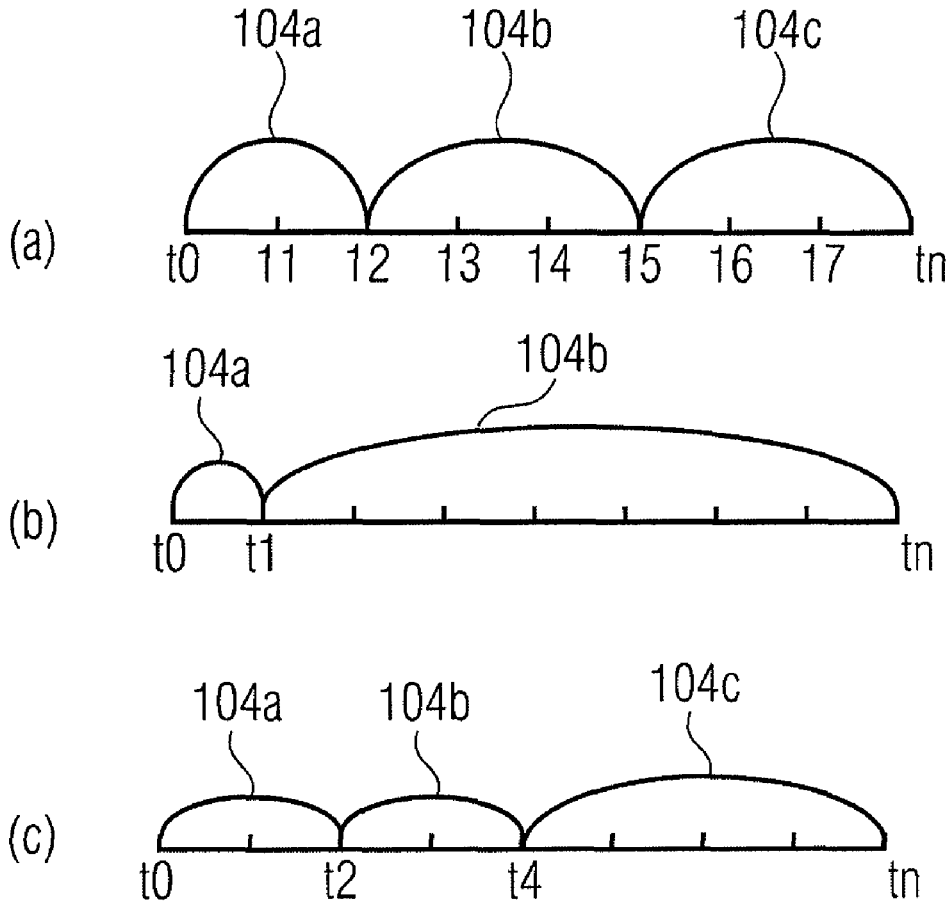
FIGS. 5*a* to 5*c* show further partitions for an SBR frame comprising three envelopes covering different numbers of time portions.

FIG. 5 illustrates further embodiments in which the length of the envelopes varies over the SBR frame. In FIG. 5*a*, an example is shown with three envelopes 104, a first envelope 104*a*, a second envelope 104*b* and a third envelope 104*c*. The first envelope 104*a* extends from the initial time t0 to the border 2 at time t2, the second envelope 104*b* extends from border 2 at time t2 to border 5 at time t5 and the third envelope 104*c* extends from border 5 at time t5 to the final time tn. If all time portions are, again, of the same length and if the SBR frame is, again, divided into eight time portions, the first envelope 104*a* covers the first and second time portions 111, 112, the second envelope 104*b* covers the third, the fourth and the fifth time portions 113 to 115 and the third envelope 104*c* covers the sixth, the seventh and the eighth time portions. Therefore, the first envelope 104*a* is smaller than the second and the third envelopes 104*b* and 104*c*.

FIG. 5*b* shows another embodiment with only two envelopes, a first envelope 104*a* extending from the initial time t0 to the first time t1 and a second envelope 104*b* extending from the first time t1 to the final time tn. Therefore, the second envelope 104*b* extends over 7 time portions, whereas the first envelope 104*a* extends only over a single time portion (the first time portion 111).

FIG. 5*c* shows, again, an embodiment with three envelopes 104, wherein the first envelope 104*a* extends from the initial time t0 to the second time t2, the second envelope 104*b* extends from the second time t2 to the fourth time t4 and the third envelope 104*c* extends from the fourth time t4 to the final time tn.

These embodiments may, for example, be used in case that borders of envelopes 104 are only put between neighboring time portions in which a violation of the threshold is detected or at the initial and final time t0, tn. This means that in FIG. 5*a*, a violation is detected at time t2 and a violation is detected at time t5, whereas no violations are detected at the remaining time moments t1 t3, t4, t6 and t7. Similarly, in FIG. 5*b*, a violation is only detected at the time t1, resulting in a border for the first envelope 104*a* and for the second envelope 104*b* and in FIG. 5*c*, a violation is detected only at the second time t2 and the fourth time t4.

In order that a decoder is able to use the envelope data and to replicate accordingly the spectral higher band, the decoder needs the position of the envelopes 104 and of the corresponding envelope borders. In the embodiments as shown before, which rely on said standard, wherein all envelopes 104 comprise the same length and, hence, it was sufficient to transmit the number of envelopes so that the decoder can decide where an envelope border has to be. In these embodiments as shown in FIG. 5 however, the decoder needs information at which time an envelope border is positioned and thus additional side information may be put into the data stream so that using the side information, the decoder can retain the time moments where a border is placed and an envelop starts and ends. This additional information comprises the time t2 and t5 (in FIG. 5*a* case), the time t1 (in FIG. 5*b* case) and the time t2 and t4 (in FIG. 5*c* case).

Figure 6A:
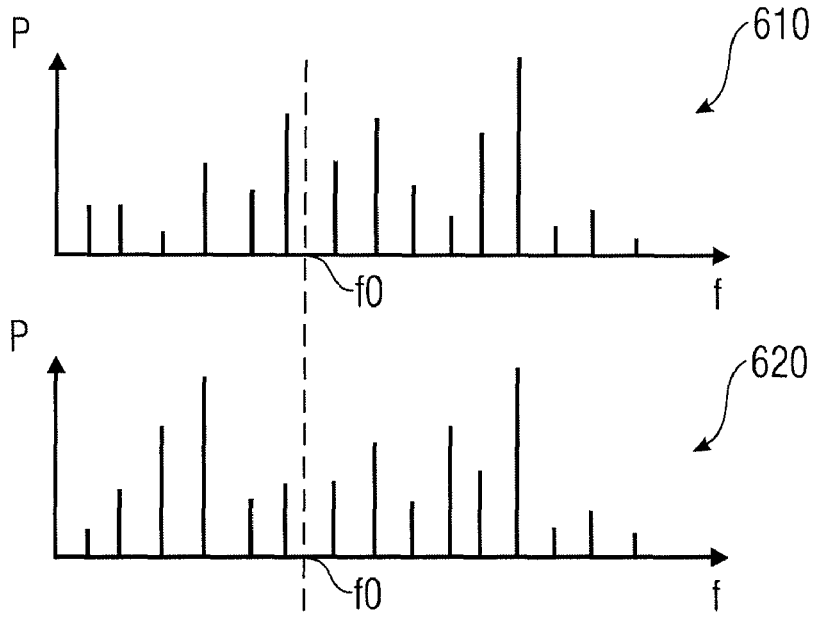
FIGS. 6*a* and 6*b* illustrate the spectral energy distribution for signals within neighboring time portions.
Figure 6B:
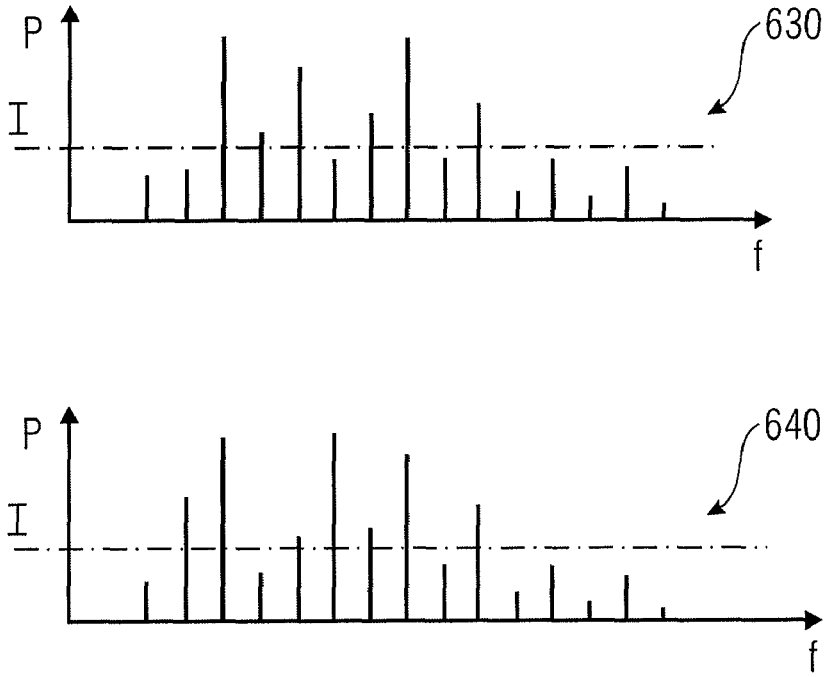

FIGS. 6*a* and 6*b* show an embodiment for the decision value calculator 120 by using the spectral energy distribution in the audio signal 105.

FIG. 6*a* shows a first set of sample values 610 for the audio signal in a given time portion, e.g., the first time portion 111 and compares this sampled audio signal with a second set of samples of the audio signal 620 in the second time portion 112. The audio signal was transformed into the frequency domain so that the sets of sample values 610, 620 or their levels P are shown as a function of the frequency f. The lower and the higher frequency bands are separated by the crossover frequency f0 implying that for higher frequencies than f0 sample values will not be transmitted. The decoder should instead replicate these sample values by using the SBR data. On the other hand, the samples below the crossover frequency f0 are encoded, for example, by the AAC encoder and transmitted to the decoder.

The decoder may use these sample values from the low frequency band in order to replicate the high frequency components. Therefore, in order to find a measure for the deviation of the first set of samples 610 in the first time portion 111 and the second set of samples 620 in the second time portion 112, it may not be sufficient to consider only the sample values in the high frequency band (for f>f0), but also take into account the frequency components in the low frequency band. In general, a good quality replication is to be expected if there is a correlation between the frequency components in the high frequency band with respect to the frequency components in the low frequency band. In a first step, it may be sufficient to consider only sample values in the high frequency band (above the crossover frequency f0) and to calculate a correlation between the first set of sample values 610 with the second set of sample values 620.

The correlation may be calculated by using standard statistic methods and may comprise, for example, the calculation of the so-called cross correlation function or other statistical measures for the similarity of two signals. There is also Pearson's product moment correlation coefficient, which may be used to estimate a correlation of two signals. The Pearson coefficients are also known as a sample correlation coefficient. In general, a correlation indicates the strength and direction of a linear relationship between two random variables—in this case, the two sample distributions 610 and 620. Therefore, the correlation refers to the departure of two random variables from independence. In this broad sense, there are several coefficients measuring the degree of correlation adapted to the nature of data so that different coefficients are used for different situations.

FIG. 6*b* shows a third set of sample values 630 and a fourth set of sample values 640, which may, for example, be related to the sample values in the third time portion 113 and the fourth time portion 114. Again, in order to compare the two sets of samples (or signals), two neighboring time portions are considered. In contrast to the case as shown in FIG. 6*a*, in FIG. 6*b* a threshold T is introduced so that only sample values are considered whose level P are above (or more general violates) the threshold T (for which P>T holds).

In this embodiment the deviation in the spectral energy distributions may be measured simply by counting the number of sample values with violating this threshold T and the result may fix the decision value 125. This simple method will yield a correlation between both signals without performing a detailed statistical analysis of the various sets of sample values in the various time portions 110. Alternatively, a statistical analysis, e.g. as mentioned above, may be applied to the samples that violates the threshold T only.

Figure 7A:
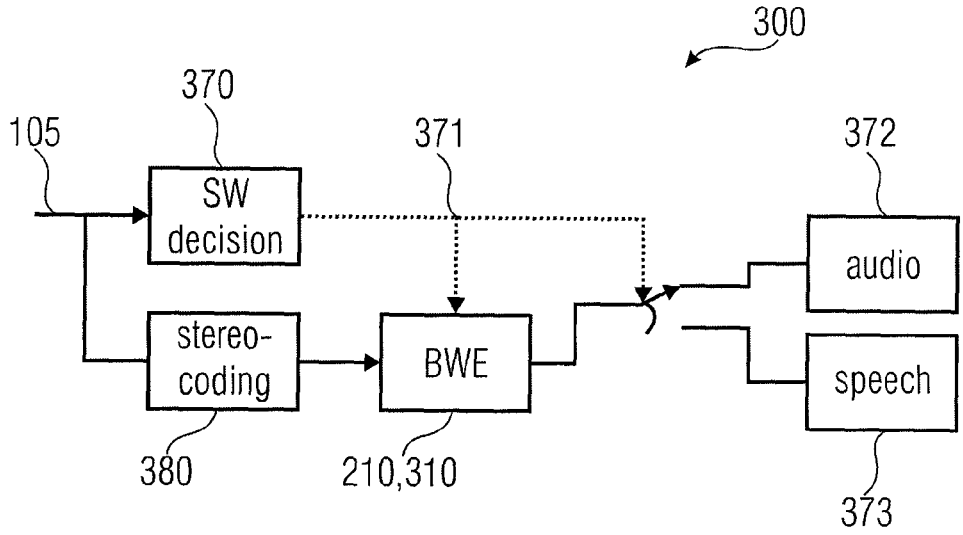
FIGS. 7*a* to 7*c* show an encoder comprising an optional audio/speech-switch resulting in different temporal resolution for an audio signal.
Figure 7B:
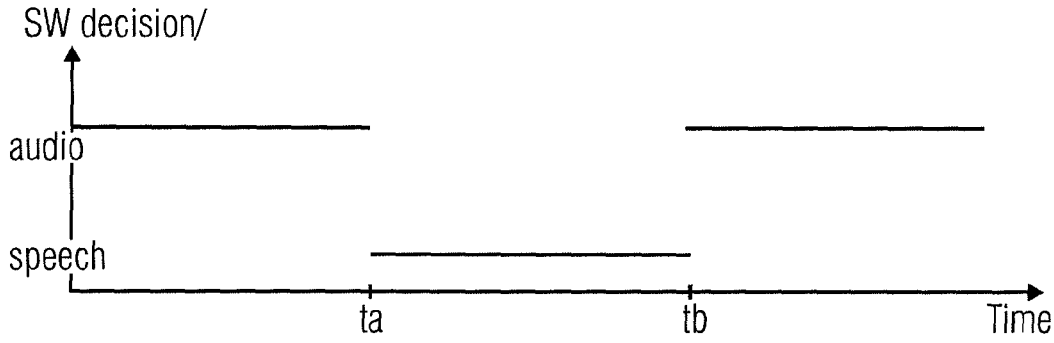
Figure 7C:
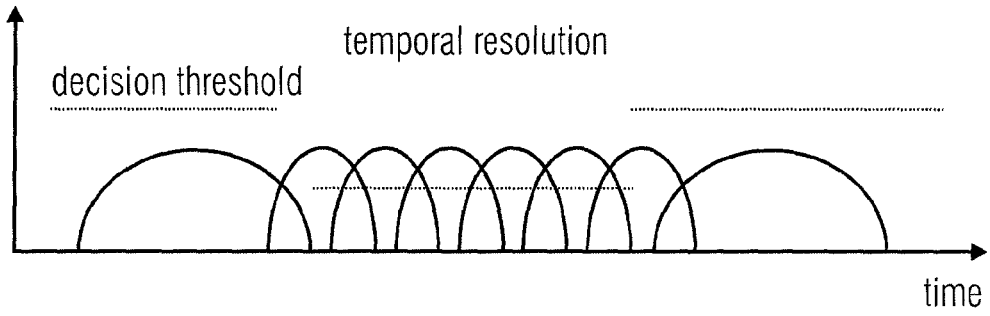

FIGS. 7*a* to 7*c* show a further embodiment where the encoder 300 comprises a switch-decision unit 370 and a stereo coding unit 380. In addition, the encoder 300 also comprises the bandwidth extension tools as, for example, the envelope data calculator 210 and the SBR-related modules 310. The switch-decision unit 370 provides a switch decision signal 371 that switches between an audio coder 372 and a speech coder 373.

Each of these codes may encode the audio signal in the core frequency band using different numbers of sample values (e.g. 1024 for a higher resolution or 256 for a lower resolution). The switch decision signal 371 is also supplied to the bandwidth extension (BWE) tool 210, 310. The BWE tool 210, 310 will then use the switch decision 371 in order, for example, to adjust the thresholds for determining the number 102 of the spectral envelopes 104 and to turn on/off an optional transient detector. The audio signal 105 is input into the switch-decision unit 370 and is input into the stereo coding 380 so that the stereo coding 380 may produce the sample values, which are input into the bandwidth extension unit 210, 310. Depending on the decision 371 generated by the switch-unit decision unit 370, the bandwidth extension tool 210, 310 will generate spectral band replication data, which are, in turn, forwarded either to an audio coder 372 or a speech coder 373.

The switch decision signal 371 is signal dependent and can be obtained by the switch-decision unit 370 by analyzing the audio signal, e.g., by using a transient detector or other detectors, which may or may not comprise a variable threshold. Alternatively, the switch decision signal 371 can also be manually be adjusted or be obtained from a data stream (included in the audio signal).

The output of the audio coder 372 and the speech coder 373 may again be input into the bitstream formatter 350 (see FIG. 3*a*).

FIG. 7*b* shows an example for the switch decision signal 371, which detects an audio signal for a time period below a first time ta and above a second time tb. Between the first time ta and the second time tb, the switch-decision unit 370 detects a speech signal implying different discrete values for the switch decision signal 371.

As a result, as shown in FIG. 7*c*, during the time, the audio signal is detected, that means for times before ta, the temporal resolution of the encoding is low, whereas during the period where a speech signal is detected (between the first time ta and the second time tb), the temporal resolution is increased. An increase in the temporal resolution implies a shorter analyzing window in the time domain. The increased temporal resolution implies also the aforementioned increased number of spectral envelopes (see description to FIG. 4).

For speech signals that need an exact temporal representation of the high frequencies, the decision threshold (e.g. used at FIG. 4) to transmit a higher number of parameters sets is controlled by the switching decision unit 370. For speech and speech-like signals, which are coded with the speech or time-domain coding part 373 of the switched core coder, the decision threshold to use more parameter sets may, for example, be reduced and, therefore, the temporal resolution is increased. This, however, is not always the case as mentioned above. The adaptation of the time-like resolution to the signal is independent of the underlying coder structure (which was not used in FIG. 4). This means that the described method is also usable within a system in which the SBR module comprises only a single core coder.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

The inventive encoded audio signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disk, a DVD, a CD, a ROM, a PROM, an EPROM, an EEPROM or a FLASH memory, having electronically readable control signals stored thereon, which cooperate (or are capable of cooperating) with a programmable computer system such that the respective method is performed.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods may be performed by any hardware apparatus.

The above described embodiments are merely illustrative for the principles of the present invention. It is understood that modifications and variations of the arrangements and the details described herein will be apparent to others skilled in the art. It is the intent, therefore, to be limited only by the scope of the impending patent claims and not by the specific details presented by way of description and explanation of the embodiments herein.

The invention claimed is:

1. An apparatus for calculating a number of spectral envelopes to be derived by a spectral band replication (SBR) encoder, wherein the SBR encoder is adapted to encode an audio signal using a plurality of sample values within a predetermined number of subsequent time portions in an SBR frame extending from an initial time to a final time, the predetermined number of subsequent time portions being arranged in a time sequence given by the audio signal, the apparatus comprising:

a decision value calculator configured to determining a decision value, the decision value measuring a deviation in spectral energy distributions of a pair of neighboring time portions;

a detector configured to detecting a violation of a threshold by the decision value;

a processor configured to determining a first envelope border between the pair of neighboring time portions when the violation of the threshold is detected;

a processor configured to determining a second envelope border between a different pair of neighboring time portions or at the initial time or at the final time for an envelope comprising the first envelope border based on the violation of the threshold for the other pair or based on a temporal position of the pair or the different pair in the SBR frame; and a number processor configured to establishing the number of spectral envelopes comprising the first envelope border and the second envelope border, wherein the predetermined number of time portions is equal to n with n−1 borders between neighboring time portions, which are numbered and ordered with respect to the time so that the borders comprise even and odd borders, and wherein the number processor is adapted to establish n as the number of spectral envelopes if the detector detects the violation at an odd border.

2. The apparatus of claim 1, in which a length in time of a time portion of the predetermined number of subsequent time portions is equal to a minimal length in time, for which a single envelope is determined, and in which the decision value calculator is adapted to calculate a decision value for two neighboring time portions comprising the minimal length in time.

3. The apparatus of claim 1, wherein the processor is adapted to fix the first border at a first detected violation, and wherein the processor is adapted to fix the second envelope border after comparing of at least one other decision value with the threshold.

4. The apparatus of claim 3, further comprising an information processor configured to providing additional side information, the additional side information comprises the first envelope border and the second envelope border within the time sequence of the audio signal.

5. The apparatus of claim 1, wherein the detector is adapted to investigate in a temporal order each of the borders between neighboring time portions.

6. The apparatus of claim 1, wherein the detector is adapted to detect first the violation at odd borders.

7. The apparatus of claim 1, further comprising a transient detector with a transient threshold, the transient threshold being larger than the threshold and/or further comprising an envelope data calculator, the envelope data calculator being adapted to calculate spectral envelope data for a spectral envelope extending from the first envelope border to the second envelope border.

8. A method for calculating a number of spectral envelopes to be derived by a spectral band replication (SBR) encoder, wherein the SBR encoder is adapted to encode an audio signal using a plurality of sample values within a predetermined number of subsequent time portions in an SBR frame extending from an initial time to a final time, the predetermined number of subsequent time portions being arranged in a time sequence given by the audio signal, the method comprising:

determining a decision value, the decision value measuring a deviation in spectral energy distributions of a pair of neighboring time portions;

detecting a violation of a threshold by the decision value;

determining a first envelope border between the pair of neighboring time portions when the violation of the threshold is detected;

determining a second envelope border between a different pair of neighboring time portions or at the initial time or at the final time for an envelope comprising the first envelope border based on the violation of the threshold for the other pair or based on a temporal position of the pair or the different pair in the SBR frame; and establishing the number of spectral envelopes comprising the first envelope border and the second envelope border, wherein the predetermined number of time portions is equal to n with n−1 borders between neighboring time portions, which are numbered and ordered with respect to the time so that the borders comprise even and odd borders, and wherein n is established as the number of spectral envelopes if violation at an odd border is detected.

9. A non-transitory storage medium having stored thereon a computer program for performing, when running on a processor, a method for calculating a number of spectral envelopes to be derived by a spectral band replication (SBR) encoder, wherein the SBR encoder is adapted to encode an audio signal using a plurality of sample values within a predetermined number of subsequent time portions in an SBR frame extending from an initial time to a final time, the predetermined number of subsequent time portions being arranged in a time sequence given by the audio signal, the method comprising:

determining a decision value, the decision value measuring a deviation in spectral energy distributions of a pair of neighboring time portions; detecting a violation of a threshold by the decision value; determining a first envelope border between the pair of neighboring time portions when the violation of the threshold is detected; determining a second envelope border between a different pair of neighboring time portions or at the initial time or at the final time for an envelope comprising the first envelope border based on the violation of the threshold for the other pair or based on a temporal position of the pair or the different pair in the SBR frame; and establishing the number of spectral envelopes comprising the first envelope border and the second envelope border, wherein the predetermined number of time portions is equal to n with n−1 borders between neighboring time portions, which are numbered and ordered with respect to the time so that the borders comprise even and odd borders, and wherein n is established as the number of spectral envelopes if violation at an odd border is detected.

10. An apparatus for calculating a number of spectral envelopes to be derived by a spectral band replication (SBR) encoder, wherein the SBR encoder is adapted to encode an audio signal using a plurality of sample values within a predetermined number of subsequent time portions in an SBR frame extending from an initial time to a final time, the predetermined number of subsequent time portions being arranged in a time sequence given by the audio signal, the apparatus comprising:

a decision value calculator configured to determining a decision value, the decision value measuring a deviation in spectral energy distributions of a pair of neighboring time portions;

a detector configured to detecting a violation of a threshold by the decision value;

a processor configured to determining a first envelope border between the pair of neighboring time portions when the violation of the threshold is detected;

a processor configured to determining a second envelope border between a different pair of neighboring time portions or at the initial time or at the final time for an envelope comprising the first envelope border based on the violation of the threshold for the other pair or based on a temporal position of the pair or the different pair in the SBR frame; and a number processor configured to establishing the number of spectral envelopes comprising the first envelope border and the second envelope border, wherein the detector is adapted to determine the second border such that the spectral envelopes comprise a same temporal length and the number of spectral envelopes is a power of two.

11. The apparatus of claim 10, wherein the predetermined number is equal to 8, and wherein the number processor is adapted to establish the number of spectral envelopes to 1, 2, 4 or 8 such that each of the spectral envelopes comprises a same temporal length.

12. The apparatus of claim 10, wherein the detector is adapted to use a threshold, which depends on a temporal position of the violation such that at a temporal position yielding a larger number of spectral envelopes a higher threshold is used than for a temporal position yielding a lower number of spectral envelopes.

13. A method for calculating a number of spectral envelopes to be derived by a spectral band replication (SBR) encoder, wherein the SBR encoder is adapted to encode an audio signal using a plurality of sample values within a predetermined number of subsequent time portions in an SBR frame extending from an initial time to a final time, the predetermined number of subsequent time portions being arranged in a time sequence given by the audio signal, the method comprising:

determining a decision value, the decision value measuring a deviation in spectral energy distributions of a pair of neighboring time portions;

detecting a violation of a threshold by the decision value;

determining a first envelope border between the pair of neighboring time portions when the violation of the threshold is detected;

determining a second envelope border between a different pair of neighboring time portions or at the initial time or at the final time for an envelope comprising the first envelope border based on the violation of the threshold for the other pair or based on a temporal position of the pair or the different pair in the SBR frame; and establishing the number of spectral envelopes comprising the first envelope border and the second envelope border, wherein the second border is determined such that the spectral envelopes comprise a same temporal length and the number of spectral envelopes is a power of two.

14. A non-transitory storage medium having stored thereon a computer program for performing, when running on a processor, a method for calculating a number of spectral envelopes to be derived by a spectral band replication (SBR) encoder, wherein the SBR encoder is adapted to encode an audio signal using a plurality of sample values within a predetermined number of subsequent time portions in an SBR frame extending from an initial time to a final time, the predetermined number of subsequent time portions being arranged in a time sequence given by the audio signal, the method comprising:

determining a decision value, the decision value measuring a deviation in spectral energy distributions of a pair of neighboring time portions; detecting a violation of a threshold by the decision value; determining a first envelope border between the pair of neighboring time portions when the violation of the threshold is detected; determining a second envelope border between a different pair of neighboring time portions or at the initial time or at the final time for an envelope comprising the first envelope border based on the violation of the threshold for the other pair or based on a temporal position of the pair or the different pair in the SBR frame; and establishing the number of spectral envelopes comprising the first envelope border and the second envelope border, wherein the second border is determined such that the spectral envelopes comprise a same temporal length and the number of spectral envelopes is a power of two.

15. An apparatus for calculating a number of spectral envelopes to be derived by a spectral band replication (SBR) encoder, wherein the SBR encoder is adapted to encode an audio signal using a plurality of sample values within a predetermined number of subsequent time portions in an SBR frame extending from an initial time to a final time, the predetermined number of subsequent time portions being arranged in a time sequence given by the audio signal, the apparatus comprising:

a decision value calculator configured to determining a decision value, the decision value measuring a deviation in spectral energy distributions of a pair of neighboring time portions;

a detector configured to detecting a violation of a threshold by the decision value;

a processor configured to determining a first envelope border between the pair of neighboring time portions when the violation of the threshold is detected;

a processor configured to determining a second envelope border between a different pair of neighboring time portions or at the initial time or at the final time for an envelope comprising the first envelope border based on the violation of the threshold for the other pair or based on a temporal position of the pair or the different pair in the SBR frame;

a number processor configured to establishing the number of spectral envelopes comprising the first envelope border and the second envelope border; and a switch decision unit configured to provide a switch decision signal, the switch decision signal signals a speech-like audio signal and a general audio-like audio signal, wherein the detector is adapted to lower the threshold for speech-like audio signals.

16. A method for calculating a number of spectral envelopes to be derived by a spectral band replication (SBR) encoder, wherein the SBR encoder is adapted to encode an audio signal using a plurality of sample values within a predetermined number of subsequent time portions in an SBR frame extending from an initial time to a final time, the predetermined number of subsequent time portions being arranged in a time sequence given by the audio signal, the method comprising:

determining a decision value, the decision value measuring a deviation in spectral energy distributions of a pair of neighboring time portions;

detecting a violation of a threshold by the decision value;

determining a first envelope border between the pair of neighboring time portions when the violation of the threshold is detected;

determining a second envelope border between a different pair of neighboring time portions or at the initial time or at the final time for an envelope comprising the first envelope border based on the violation of the threshold for the other pair or based on a temporal position of the pair or the different pair in the SBR frame;

establishing the number of spectral envelopes comprising the first envelope border and the second envelope border, wherein a switch decision signal is provided, the switch decision signal signaling a speech-like audio signal and a general audio-like audio signal, wherein the threshold is lowered for speech-like audio signals.

17. A non-transitory storage medium having stored thereon a computer program for performing, when running on a processor, a method for calculating a number of spectral envelopes to be derived by a spectral band replication (SBR) encoder, wherein the SBR encoder is adapted to encode an audio signal using a plurality of sample values within a predetermined number of subsequent time portions in an SBR frame extending from an initial time to a final time, the predetermined number of subsequent time portions being arranged in a time sequence given by the audio signal, the method comprising:

determining a decision value, the decision value measuring a deviation in spectral energy distributions of a pair of neighboring time portions; detecting a violation of a threshold by the decision value; determining a first envelope border between the pair of neighboring time portions when the violation of the threshold is detected; determining a second envelope border between a different pair of neighboring time portions or at the initial time or at the final time for an envelope comprising the first envelope border based on the violation of the threshold for the other pair or based on a temporal position of the pair or the different pair in the SBR frame; and establishing the number of spectral envelopes comprising the first envelope border and the second envelope border, wherein a switch decision signal is provided, the switch decision signal signaling a speech-like audio signal and a general audio-like audio signal, wherein the threshold is lowered for speech-like audio signals.

18. An encoder for encoding an audio signal comprising:

a core coder configured to encoding the audio signal within a core frequency band;

an apparatus configured to calculating a number of spectral envelopes to be derived by a spectral band replication (SBR) encoder, wherein the SBR encoder is adapted to encode an audio signal using a plurality of sample values within a predetermined number of subsequent time portions in an SBR frame extending from an initial time to a final time, the predetermined number of subsequent time portions being arranged in a time sequence given by the audio signal, the apparatus comprising: a decision value calculator configured to determining a decision value, the decision value measuring a deviation in spectral energy distributions of a pair of neighboring time portions; a detector configured to detecting a violation of a threshold by the decision value; a processor configured to determining a first envelope border between the pair of neighboring time portions when the violation of the threshold is detected; a processor configured to determining a second envelope border between a different pair of neighboring time portions or at the initial time or at the final time for an envelope comprising the first envelope border based on the violation of the threshold for the other pair or based on a temporal position of the pair or the different pair in the SBR frame; and a number processor configured to establishing the number of spectral envelopes comprising the first envelope border and the second envelope border, wherein the predetermined number of time portions is equal to n with n−1 borders between neighboring time portions, which are numbered and ordered with respect to the time so that the borders comprise even and odd borders, and wherein the number processor is adapted to establish n as the number of spectral envelopes if the detector detects the violation at an odd border; or wherein the detector is adapted to determine the second border such that the spectral envelopes comprise a same temporal length and the number of spectral envelopes is a power of two; or further comprising a switch decision unit configured to provide a switch decision signal, the switch decision signal signals a speech-like audio signal and a general audio-like audio signal, wherein the detector is adapted to lower the threshold for speech-like audio signals; and an envelope data calculator configured to calculating envelope data based on the audio signal and the number.

* * * * *